US005451113A

United States Patent [19]

Lund et al.

[11] Patent Number: 5,451,113

[45] Date of Patent: Sep. 19, 1995

[54] PROTECTIVE UNDERCAP AND METHOD

[75] Inventors: Doug M. Lund, Bartlett; John M. B. Ford, Cordova; Bernard M. O'Brien, Germantown, all of Tenn.

[73] Assignee: Maybelline Intermediate Corp., Wilmington, Del.

[21] Appl. No.: 164,712

[22] Filed: Dec. 10, 1993

[51] Int. Cl.[6] ..... A45D 40/00; A45D 40/06

[52] U.S. Cl. ..... 401/98; 206/385; 220/377; 401/192

[58] Field of Search ..... 401/98, 192, 68; 206/385; 215/254, 251; 220/353, 377

[56] References Cited

U.S. PATENT DOCUMENTS

| | | | |
|---|---|---|---|
| 2,629,489 | 2/1953 | De Shelly . | |
| 2,678,128 | 5/1954 | Sherman . | |
| 3,341,006 | 9/1967 | Bindler . | |
| 3,511,402 | 5/1970 | Cheeley | 215/254 |
| 3,746,201 | 7/1973 | Fujio | 215/254 X |
| 4,208,144 | 6/1980 | Idec et al. | 401/192 |
| 4,311,402 | 1/1982 | Brown . | |
| 4,412,630 | 11/1983 | Daenen | 220/353 |
| 4,422,545 | 12/1983 | Kadoory . | |
| 4,579,134 | 4/1986 | Moore | 401/192 X |
| 4,813,801 | 3/1989 | Cardia | 206/385 X |
| 5,257,704 | 11/1993 | Gutt | 401/68 X |

FOREIGN PATENT DOCUMENTS

| | | | |
|---|---|---|---|
| 2657822 | 8/1991 | France | 401/98 |
| 1311039 | 3/1973 | United Kingdom | 401/98 |

*Primary Examiner*—Steven A. Bratlie
*Attorney, Agent, or Firm*—Sherman and Shalloway

[57] ABSTRACT

The invention comprises a transparent, molded undercap which fits over the open end of a lipstick type case from which a lipstick or other similar waxy mass is propelled and which engages the shoulder of the case normally engaged by the lipstick cap when it is in place. The undercap is sized to fit snuggly within the lipstick cap yet permit the cap to be removed while the undercap remains in place over the lipstick. Preferably, the open end of the undercap has a size and shape which is substantially identical to that of the cap so as to form an even closure with the lipstick case whereby a tamper indicating or resistant means, such as an adhesive tape or a shrink band, may be applied across the juncture between the undercap and the case to secure the undercap in place and seal the lipstick. In this manner, the lipstick cap may be removed from the lipstick case to view the lipstick while the undercap remains in place to protect the lipstick. When the lipstick case has a polygonal cross section, molding the undercap to fit the lipstick case also serves to prevent actuation of the propelling mechanism, even when the lipstick cap is removed, since it resists the relative rotation of the lipstick case and the lipstick tube which normally actuates the propelling mechanism. Alternatively, the case and undercap may be provided with other means, such as cooperating detents, whereby actuation of the propelling mechanism is prevented.

27 Claims, 4 Drawing Sheets

PROTECTIVE UNDERCAP AND METHOD

FIELD OF THE INVENTION

The present invention is directed to a protective undercap for, and method of sealing and protecting carded and uncarded lipsticks and similar items. The invention is applicable to any waxy mass which is housed in a case from which it is propellable to a position of use and retractable into for storage, a removable cap being used as a closure. Such items include, but are not limited to, lipsticks, theatrical make-up, marking crayons, cosmetics, toiletries and the like. The invention is particularly applicable to use on lipsticks for commercial sale as a means to seal and protect the lipstick mass prior to such sale while reducing to a minimum the amount of packaging which is discarded. The invention will be described in connection with a common lipstick, however, it is not considered to be solely limited to such use.

BACKGROUND OF THE INVENTION

Lipsticks and similar items are marketed in carded and uncarded forms. In the carded form the lipstick is confined on a supporting card generally by means of a blister molded so as to fit over and enclose the lipstick. In the uncarded form, the lipstick, with its cover in place, is usually placed in a rack with a plurality of similar lipsticks and the customer simply removes the lipstick from the rack. In order to maintain the lipstick in a pure and protected state, the cap of the lipstick is generally sealed in place with a tamper evident or resistant means, such as a shrink band, applied over the junction between the cap and the body of the lipstick housing. Although it is well known to provide a lipstick with a transparent cap as shown in U.S. Pat. No. 2,629,489, DeShelly, U.S. Pat. No. 4,311,402, Brown, and U.S. Pat. No. 4,422,545, Kadoory, when the cap is made from an opaque material to match the rest of the lipstick case, it is impossible for the prospective purchaser to determine the exact shade of the lipstick unless the seal is broken and the cap is removed.

Furthermore, it is desirable that operation of the propelling mechanism of the lipstick be prevented or, at least, discouraged even when the cap is removed to view the lipstick mass to avoid inadvertent damage to the lipstick mass. Removal of the cap of a lipstick case to view the color of the lipstick also removes any physical or mechanical barrier to operation of the propelling mechanism. In addition, some lipstick case designs permit operation of the propelling mechanism with the cap in place in which case the lipstick mass may be inadvertently driven against the inside of the cap causing damage to the lipstick mass.

In the case of carded lipsticks it is also desired to be able to view the actual color of the lipstick. However, in view of the crushable nature of the molded blisters used in such packaging means, protection is still necessary. U.S. Pat. No. 3,341,006, Bindler, discloses a carded lipstick in which the lipstick and the cap are separately packaged under a blister. A comparatively rigid, transparent plastic sleeve is applied over the extended and exposed lipstick mass to protect the mass within the blister. This sleeve is a simple open ended tube which is discarded before the application of the cap and merely provides crush protection for the lipstick mass. Even in carded or blister packaging it is still desired to prevent inadvertent operation of the propelling mechanism, and Bindler does not provide such prevention.

There is a further desire to reduce the amount of packaging material used for goods in view of both economic and ecological considerations. This is reflected in a move away from carded forms of products as a method of marketing in order to save resources and reduce the amount of material that is discarded and it would be preferred to have a protective means which is equally functional in both carded and uncarded forms of packaging. The tube of Bindler requires a certain degree of rigidity which is not conducive to such a reduction of materials.

Accordingly, applicants herein have invented a new protective undercap and method of sealing and protecting lipsticks which has utility in both carded and uncarded lipsticks and which permits those lipsticks to be sealed for purity and protection while allowing the purchaser to readily view the lipstick so as to accurately determine the shade thereof.

Additionally, the present invention provides a means for preventing the inadvertent extension of the lipstick thereby preventing its coming in contact with the interior of the cap or undercap in the event a prospective purchaser attempts to work the propelling mechanism.

Furthermore, the present invention provides a means whereby the amount of packaging for a lipstick product may be reduced to a minimum without compromising the purity and protection of the product thus meeting the necessary safety and tamper protection requirements as well as new packaging requirements brought about as a result of environmental legislation.

SUMMARY OF THE INVENTION

It is an object of this invention to provide a protective undercap and a method of sealing and protecting lipsticks which is inexpensive and which is readily applicable to existing lipstick packaging in both carded and uncarded forms.

It is a further object of this invention to provide a protective undercap and method of sealing and protecting lipsticks which permits the prospective purchaser to view the actual lipstick while maintaining the lipstick in a sealed and protected state.

It is a still further object of this invention to provide a protective undercap and method of sealing and protecting lipsticks which provides the necessary level of protection and tamper indication while reducing the amount of packaging material which is discarded as waste.

Further objects and advantages will become evident from the drawings and description herein.

The invention comprises a transparent, molded undercap which fits over the open end of a lipstick or similar case from which the lipstick or other waxy mass is propelled and which engages a shoulder of the case. Preferably, the shoulder is that which is normally engaged by the open edge of the lipstick cap when it is in place; however, in an alternative embodiment, the shoulder is that which immediately surrounds the base of the lipstick tube. The undercap is sized to fit snuggly within the lipstick cap yet permit the cap to be removed while the undercap remains in place over the lipstick. In the preferred embodiment, the open end of the undercap has a size and shape which is substantially identical to that of the cap so as to form an even closure with the lipstick case whereby a tamper indicating or resistant means, such as an adhesive tape or a shrink band, may be applied across the juncture between the undercap and the case to secure the undercap in place and seal the lipstick. In this manner, the lipstick cap may be removed from the lipstick case to allow viewing of the lipstick while the undercap remains in place to protect the lipstick. Furthermore, where the lipstick case has a polygonal cross section, molding the undercap to fit the lipstick case in this manner also serves to prevent actuation of the propelling mechanism, even when the lipstick cap is removed, since the undercap will provide resistance to the relative rotation of the lipstick case and the lipstick tube thereby preventing the lipstick mass from being propelled out of the lipstick case to where it may contact the inside of the cap or undercap and sustain damage. Alternatively, the case and undercap may be provided with other means, such as cooperating detents, whereby the case and undercap are held in position relative to each other and actuation of the propelling mechanism is prevented. In a further alternative, the tamper resistant means provides sufficient resistance to deter rotation of the lipstick tube and undercap relative to the lipstick case.

BRIEF DESCRIPTION OF THE DRAWING FIGURES

DETAILED DESCRIPTION OF THE INVENTION

Figure 1:
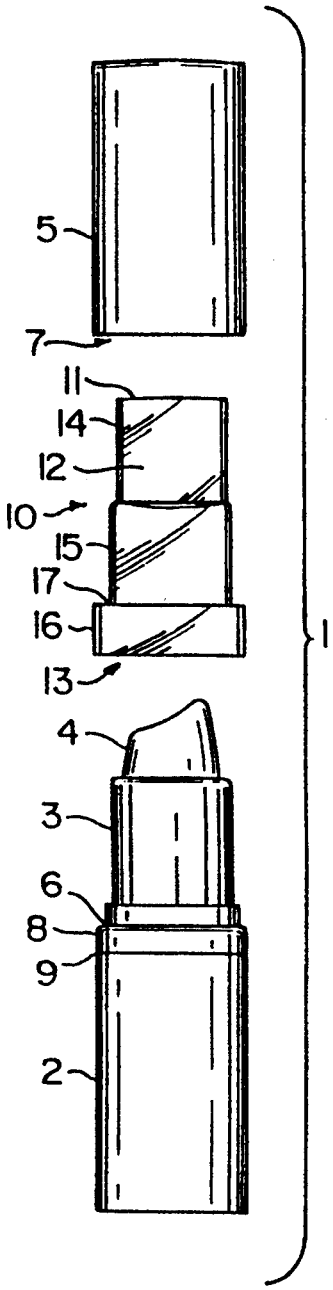
FIG. 1 is an exploded plan view of a lipstick employing the undercap of this invention.

A lipstick 1 comprises a case body 2, a lipstick tube 3, a lipstick mass 4 and a cap 5. All of these elements are arranged along a common longitudinal axis as shown in FIG. 1 so as to be substantially coaxial. Lipstick tube 3 extends outward from one end of case body 2 and houses lipstick mass 4 together with a propelling mechanism (not shown) whereby the lipstick mass is extended and retracted. The propelling mechanism is actuated by means of the relative rotation of case body 2 and tube 3. Cap 5 is placed over the open end of tube 3 when lipstick mass 4 is retracted to close the lipstick 1.

Figure 5:
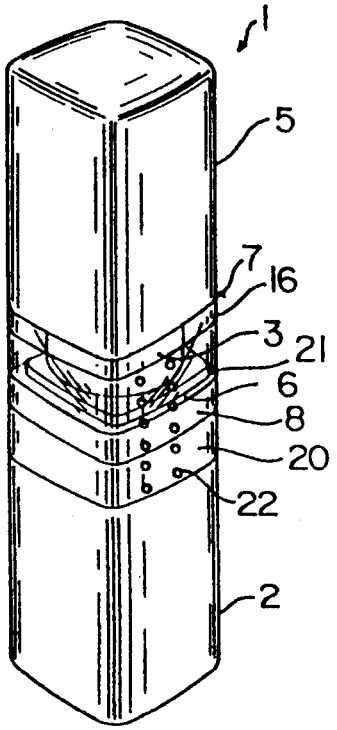
FIG. 5 is an oblique view of the lipstick of FIG. 3 with the cap in place.
Figure 6:
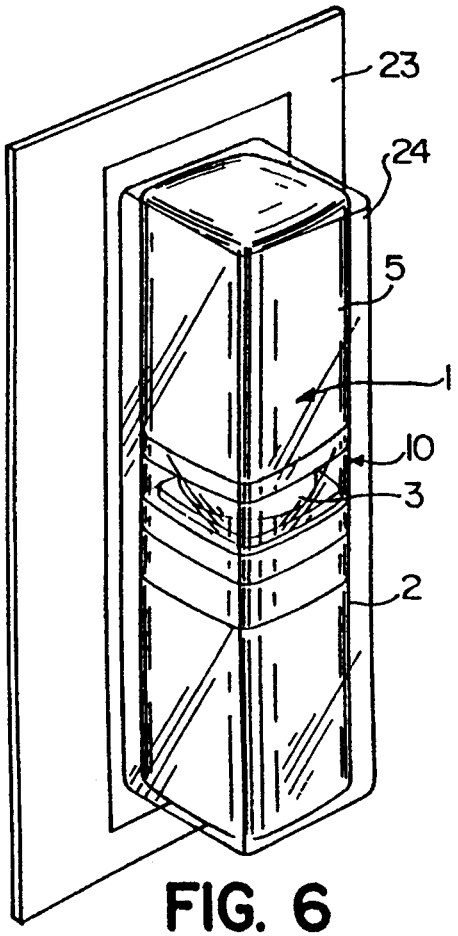
FIG. 6 is an oblique view of a blister means of packaging a lipstick employing the undercap of this invention.
Figure 7:
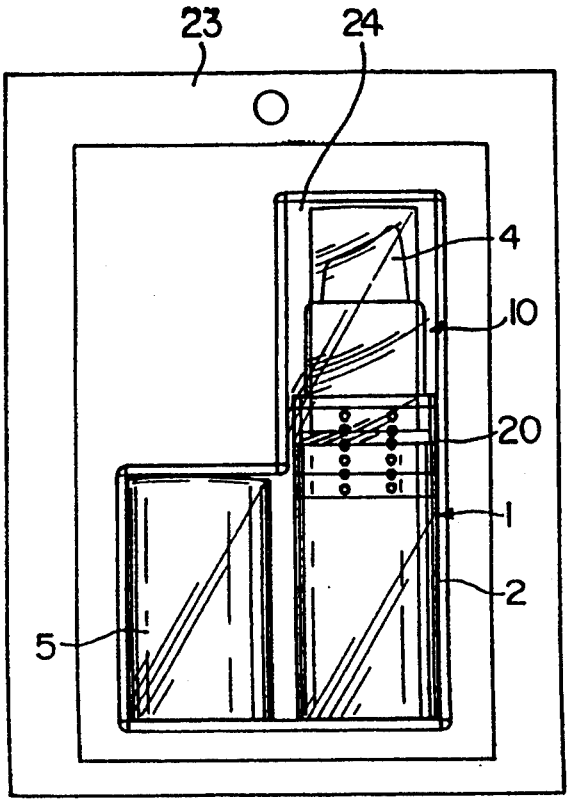
FIG. 7 is a plan view of an alternative blister means of packaging a lipstick employing the undercap of this invention.

Preferably case body 2 has a larger cross section than tube 3 and may be the same shape as tube 3 or it may be of any other cross sectional shape. In the preferred embodiment, tube 3 has a circular cross section while case body 2 and cap 5 have a preferably rectangular cross section, as shown in FIGS. 5 and 6. However, other polygonal shapes may be employed for case body 2 and cap 5 with success in the present invention. Alternative embodiments of the present invention are also applicable to lipstick cases having round cross sections. Between case body 2 and tube 3 is a shoulder 6 at which point the exterior size of lipstick 1 reduces from the size and shape of case body 2 to the size and shape of tube 3. Shoulder 6 is preferably stepped to provide an engagement surface for the lower edge 7 of cap 5, and may be molded as an integral part of case body 2 or, as illustrated, formed separately as a collar about tube 3 and including a skirt portion 8 which forms a trim band at the upper end 9 of case body 2.

A lipstick will often be provided with a label on the end of case body 2 or cap 5 to designate the color of lipstick mass 4. However, it is desirable for the prospective purchaser to be able to directly view lipstick mass 4 in order to positively determine the color thereof. Previously, this has meant allowing prospective purchasers to have access to lipstick mass 4, making cap 5 out of a transparent material thus resulting in a distinct contrast between case body 2 and cap 5, or packaging lipstick 1 in a blister type package with cap 5 removed so that lipstick mass 4 is visible. The first option is undesireable from the standpoint of health and safety inasmuch as it is preferred to maintain cosmetics in a sealed condition prior to purchase in order to prevent contamination. The second option is undesireable from the standpoint of aesthetic appearance where the lipstick is a high end product. In such instances it is preferred that case body 2 and cap 5 be opaque and of the same color. The third option is undesireable from the standpoint of the amount of packaging material which becomes waste following purchase of the lipstick. However, the present invention is applicable to use in such blister type packaging.

The present invention provides undercap 10 which is interposed between case 2 and cap 5 and which is sealable to case 2 to provide the necessary protection to lipstick mass 4 while allowing cap 5 to be removed so that the color of the lipstick mass 4 may be directly observed. Furthermore, it allows case body 2 and cap 5 to be opaque and the same color thereby providing an aesthetically pleasing package while reducing the amount of packaging waste by eliminating the need for blister type packaging.

Figure 4:
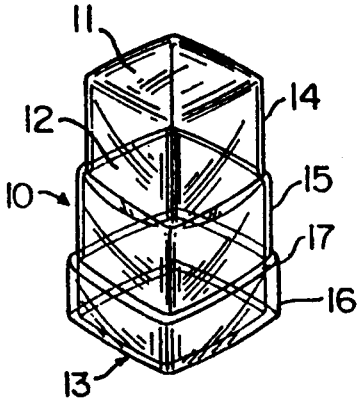
FIG. 4 is an oblique view of an undercap according to this invention.
Figure 8:
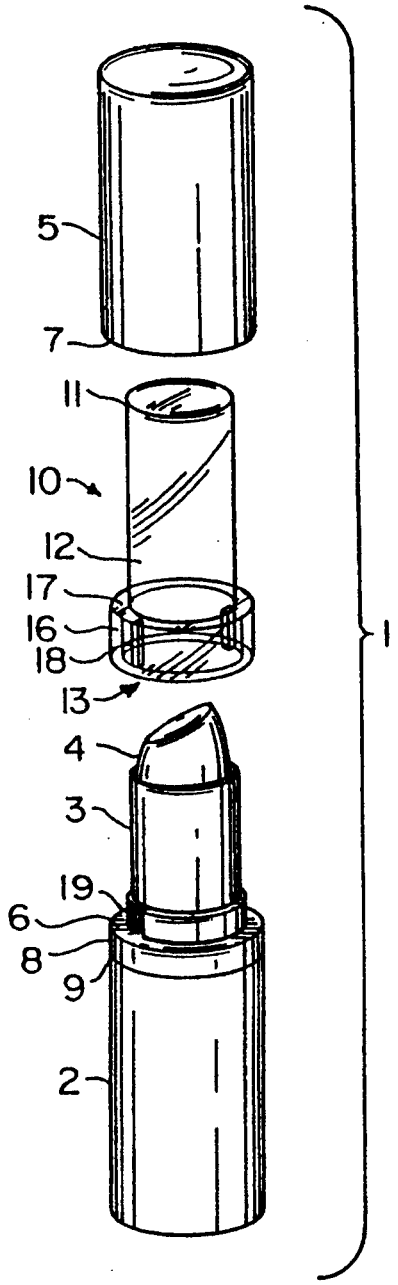
FIG. 8 is an exploded view of an alternative embodiment of the invention.

Undercap 10 comprises a molded body which fits over tube 3 and lipstick mass 4 and is substantially receivable within cap 5. The preferred form of undercap 10 is illustrated in FIG. 4 and comprises a horizontal cap wall 11 from which depends a skirt 12 having a stepped structure. The lower end 13 of undercap 10 is open and has a shape and size corresponding to that of lower end 7 of cap 5. In this manner lower end 13 of undercap 10 is capable of fully engaging shoulder 6 of case body 2 in a manner so as to be flush with case body 2. As noted, and shown in FIGS. 1 and 4, skirt 12 preferably has a stepped structure depending from horizontal cap wall 11. In this embodiment, this structure comprises three portions, upper portion 14 having a cross sectional size and shape corresponding to the inside diameter of tube 3 and capable of receiving the partially extended tip of lipstick mass 4, mid-portion 15 having a cross sectional size corresponding substantially to the outer diameter of tube 3 and a cross sectional shape preferably corresponding substantially to that of the interior of cap 5, and lower portion 16 having a shape and cross sectional size corresponding to cap 5 and capable of engaging shoulder 6 of case body 2. The overall length of undercap 10 is substantially equal to that of cap 5; however, the stepped structure of undercap 10 permits upper and mid-portions 14 and 15 to be received within cap 5. Alternatively, the upper and mid-portions of undercap 10 may be the same size with only lower portion 16 being stepped out to engage shoulder 6 of case body 2. Such an embodiment for undercap 10 is shown in FIG. 8.

Figure 2:
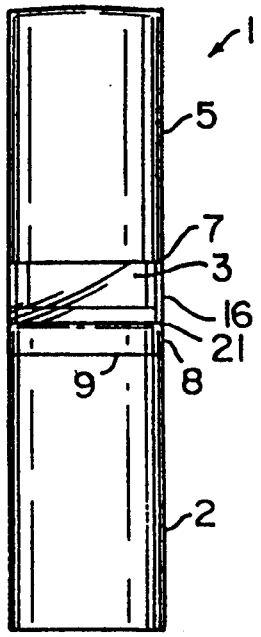
FIG. 2 is a plan view of the lipstick of FIG. 1.

As described, lower portion 16 of undercap 10 has a shape and size which corresponds to that of cap 5 and of case body 2. Accordingly, when undercap 10 and cap 5 are in place on case body 2 they will have the arrangement as seen in FIGS. 2 and 5 with lower portion 16 of undercap 10 holding cap 5 out of engagement with case body 2. The advantage of this arrangement will become evident hereinafter. In this arrangement lower edge 7 of cap 5 will engage step 17 between mid-portion 15 and lower portion 16 of undercap 10. As noted previously, upper and mid-portions 14 and 15 of undercap 10 may be the same size. In addition, they may be formed with a round cross section, as in FIG. 8, to accomodate tube 3 while lower portion 16 has a polygonal shape and size corresponding to case 2 and cap 5.

Operation of the propelling mechanism of lipstick 1 is by means of relative rotation of case body 2 and tube 3. To achieve this relative rotation, the user grasps case body 2 with one hand and tube 3 with the other hand and twists them in opposite directions. Generally, clockwise rotation of case body 2 extends lipstick mass 4 and counter clockwise rotation of case 2 retracts lipstick mass 4. Resistance to such rotation when cap 5 is removed is provided by undercap 10 by molding lower portion 16 to have the same shape and size as cap 5 so as to fit on and engage shoulder 6. Thus, even if one grasps lipstick 1 sufficiently to press mid-portion 15 of skirt 12 against tube 3 and thereby hold tube 3, the engagement of polygonal shaped lower portion 16 with the identically shaped shoulder 6 of case body 2 will provide resistance against such rotation.

Resistance to relative rotation may also be provided by means such as cooperating detents on undercap 10 and case body 2. Such alternative means are shown in FIG. 8 where the undercap 10 is shown in combination with a lipstick 1 having a case body 2 and cap 5 which have a round cross section. In such a lipstick, the engagement of lower portion 16 of undercap 10 with case body 2 at shoulder 6 could be insufficient to resist relative rotation of case body 2 and tube 3, thus allowing the propelling mechanism to be operated. In the embodiment of FIG. 8, undercap 10 is provided with inwardly extending detents 18 in lower portion 16 of skirt 12. Detents 18 fit into and engage recesses 19 which are part of shoulder 6. This order of position of detents 18 and recesses 19 may be reversed so that detents 18 are part of shoulder 6 and recesses 19 are molded in as part of undercap 10. Preferably, at least two each of detents 18 and recesses 19 are provided at positions which are 180° opposite. However, any number of such cooperating detents and recesses, or other cooperating means may be employed. Cooperating detent means may also be used where undercap 10 and case 2 have cooperating polygonal cross sections as an added resistance to operation of the propelling means.

By molding lower portion 16 of undercap 10 to correspond in shape and size to case 2 and cap 5, not only does undercap 10 provide resistance to operation of the propelling mechanism of lipstick 1, but a smooth transition between case 2 and cap 5 is effected, as shown in FIG. 2, thus giving lipstick 1 a pleasing and aesthetic appearance. Additionally, the outer surface of lower portion 16 is substantially flush with the outer surface of case 2 which provides an even surface on which to apply a sealing means 20.

Figure 3:
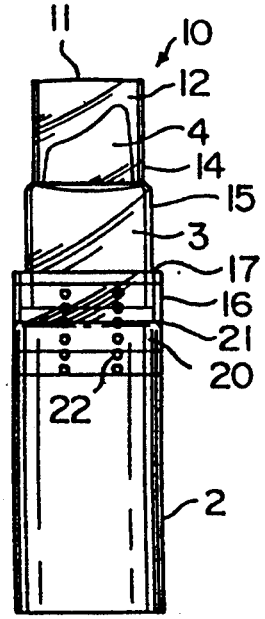
FIG. 3 is a plan view of the lipstick of FIG. 2 with the cap removed illustrating the undercap of this invention in place and sealed with a tamper resistant band.

Sealing means 20 may be any means which is adherable across juncture 21 between undercap 10 and case 2. Preferably, sealing means 20 comprises a tamper resistant band, as shown in FIGS. 3 and 5, which completely encircles case 2 and lower portion 16 of undercap 10. Such a band may be a strip of adhesive tape, a shrink band, or equivalent means and may include a rupturable portion 22 to permit removal of sealing means 20 and subsequent removal of undercap 10 following purchase of lipstick 1. Preferably, sealing means 20 does not extend over cap 5 thus allowing cap 5 to be removed for viewing of lipstick mass 4 through undercap 10 prior to sale. Rather, cap 5 has a snug fit over undercap 10 in the normal manner of lipstick caps to resist inadvertent removal yet permit purposeful removal and replacement of cap 5 over undercap 10.

Figure 9:
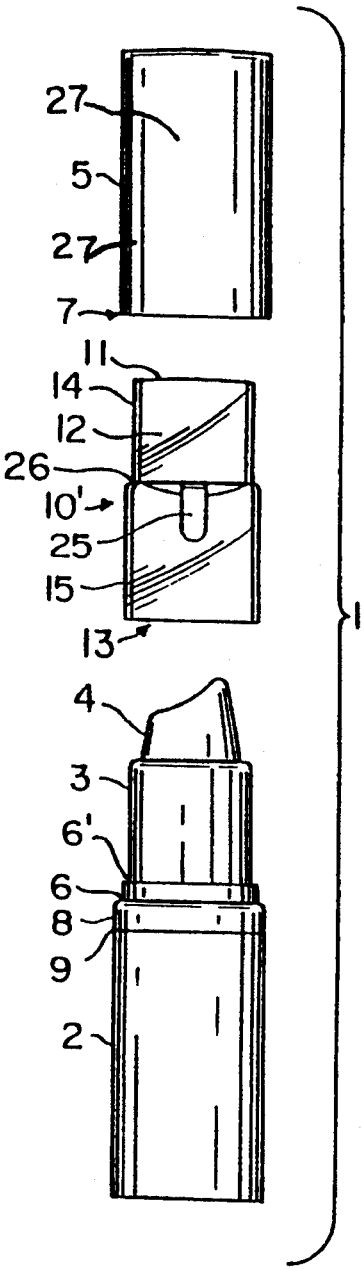
FIG. 9 is an exploded view of a further alternative embodiment of the invention.
Figure 10:
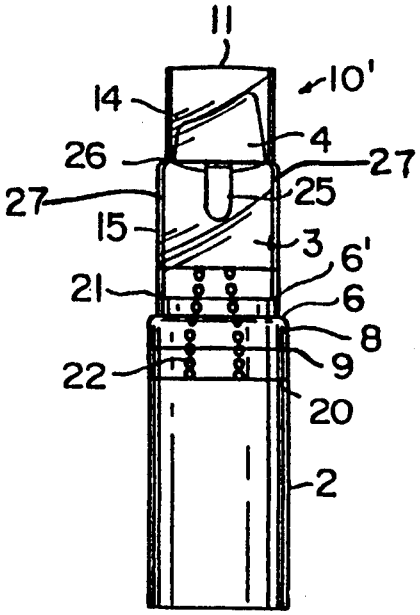
FIG. 10 is a plan view of the embodiment of FIG. 9 with the cap removed illustrating the undercap in place and sealed with a tamper resistant band.
Figure 11:
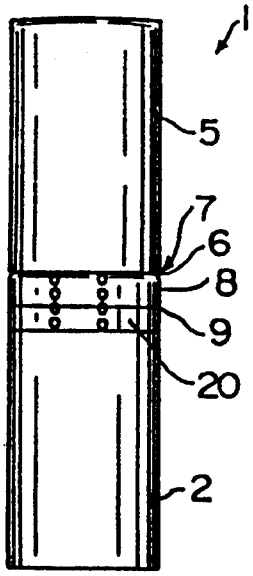
FIG. 11 is a plan view of the embodiment of FIG. 9 with the cap in place.

In a further alternative embodiment illustrated in FIGS. 9–11, undercap 10' is molded without lower portion 16 of skirt 12. In this embodiment, mid-portion 15 has a length which substantially corresponds to the length of lipstick tube 3 and has an interior dimension to fit snuggly over lipstick tube 3. As with the first embodiment of undercap 10, mid-portion 15 has an exerior shape and dimension to fit within cap 5. Lower end 13 of undercap 10' engages step 6' of shoulder 6 at the base of lipstick tube 3 leaving shoulder 6 free to engage lower end 7 of cap 5. Thus, in this embodiment, cap 5 fits completely over undercap 10' and presents a more regular lipstick 1 appearance as shown in FIG. 11. In addition, the engagement of lower end 7 of cap 5 with shoulder 6 preferably locks the propelling mechanism against operation when cap 5 is in place. Lower end 13 is preferably slightly flared to provide support of undercap 10' on step 6'.

As with the preferred embodiment, undercap 10' is secured in place by tamper evident or resistant sealing means 20. Preferably, sealing means 20 adheres to both undercap 10' and case 2 with sufficient strength to prevent relative rotation of undercap 10' and case 2 which, in turn, prevents relative rotation of lipstick tube 3 and case 2 when cap 5 is removed to view lipstick mass 4. As with the other embodiments, sealing means 20 is adherable across juncture 21 between undercap 10' and case 2, specifically, between undercap 10' and step 6'. Also, sealing means 20 may be provided with a rupturable portion 22 to permit removal of sealing means 20 and undercap 10' following purchase of lipstick 1.

It is normal for the inside of lipstick cap 5 to be provided with molded friction detents 27 which engage the outer surface of lipstick tube 3 and provide a snug fit of cap 5 on case 2. In order to facilitate such a snug fit with the undercap of the present invention, and particularly with the embodiment of FIGS. 9–11 in place, the undercap may be provided with apertures 25 in mid-portion 15. As shown in FIGS. 9 and 10 in connection with undercap 10', apertures 25 extend downward from step 26 between upper portion 14 and mid-portion 15 and are of a length which substantially corresponds to the length of the friction detents 27 in cap 5. Apertures 25 expose a portion of lipstick tube 3 for engagement with the friction detents 27 of cap 5.

FIGS. 5, 6, 7 and 11 illustrate lipstick 1 in different packaging embodiments for display and sale and incorporating the present invention. The preferred embodiments are illustrated in FIGS. 5 and 11 and comprise an uncarded lipstick 1 wherein the only disposable packaging elements are undercap 10 or 10' and sealing means 20 which, in these embodiments, preferably comprises a tamper resistant shrink band. These embodiments are particularly well adapted for use in sequential dispensing displays and permit cap 5 to be easily removed and replaced so that the lipstick mass 4 may be viewed without exposing mass 4 to contamination. This embodiment may be dispensed to purchasers by any means such as in a loose collection, a sequentially dispensing display rack, a point-of-sale display, or the like. Alternatively, lipstick 1 may be packaged in the embodiments of FIGS. 6 and 7 which illustrate blister type packages comprising supporting cards 23 and molded transparent blisters 24. In these embodiments, undercap 10 provides added protection in the event blisters 24 are punctured or become separated from supporting cards 23. In the case of the embodiment of FIG. 6, lipstick tube 3 may be manufactured from a transparent material, thus permitting the lipstick mass to be viewed therethrough without breaking blister 24 and removing cap 5.

The embodiments of undercap 10 are formed from transparent materials which are readily moldable into configurations appropriate for lipsticks. Any thermoformable plastic may be used. However, preferably, the materials used are ethylene or vinyl polymers or copolymers, acrylic resins, acetates, and the like. Most preferable are polyethylene terephthalate, styrene polymers and copolymers, and polyvinylchloride. Any molding means suitable for such materials may be used including, but not limited to, injection molding, vacuum molding, blow molding, deep draw forming, and the like. Of particular preference is vacuum molding, and materials useable therein, wherein a heat softened sheet of material is drawn over a forming mold by means of a vacuum to form a precise shape. Such methods are relatively inexpensive and lend themselves to high volume turnout of precisely formed shapes. In addition, vacuum molding permits undercap 10 to be formed with a minimal wall thickness; preferably 0.1 to 1.0 mm, most preferably 0.1 to 0.5 mm. It has been found that such thicknesses provide sufficient protective strength to undercap 10 and permit undercap 10 to have sufficient rigidity so as to resist relative rotation with case body 2 thus preventing actuation of the propelling mechanism of the lipstick 1 while significantly reducing the amount of packaging waste generated.

Thus, the present invention provides a protective undercap and a method of sealing and protecting lipsticks and similar items which is inexpensive and readily applicable to exisitng lipstick packaging in both carded and uncarded forms. The invention further provides such a protective undercap and method of sealing and protecting lipsticks which permits the prospective purchaser to view the actual lipstick while maintaing the lipstick in its sealed and protected state. Furthermore, the invention achieves this in a manner which reduces the amount of packaging material which has been previously discarded as waste.

The foregoing description sets forth preferred embodiments of the present invention. However, it is not to be construed as being limited by the illustrative embodiments. Variations and modifications may be made within the scope of the claims without departing from the inventive concepts herein disclosed.

What is claimed is:

1. In an apparatus comprising an elongated body, a central tube extending in a longitudinally coaxial relationship from said body, an upper end surface of said body forming a shoulder concentrically about said tube, a cap capable of being placed over and enclosing said tube to engage said body at said shoulder, said cap having an inner surface with frictional engagement means thereon to frictionally engage an outer surface of said tube and hold said cap in place, a waxy mass housed within said tube and said body and a propelling mechanism within said tube whereby said mass is extendable from said tube and retractable therein by relative rotation of said tube and said body, the improvement comprising;

a protective undercap removably placeable over and enclosing said tube and engaging said body about said shoulder and removably receivable within said cap whereby said protective undercap is intermediate between said cap and said tube, said cap being removable while said protective undercap remains in place over said tube and said waxy mass therein and said protective undercap providing means to resist relative rotation of said undercap and said body whereby relative rotation of said tube and said body is also resisted, wherein said protective undercap comprises a horizontal cap wall and a depending peripheral skirt, said skirt having a length which is at least equal to the length of said tube extending beyond said body and an interior dimension to closely fit about said tube, said tube being telescopically received within said skirt, and the open end of said skirt opposite to said horizontal cap wall having a cross-sectional configuration of substantially uniform wall thickness and an internal dimension substantially identical to and engaging said shoulder whereby said means to resist relative rotation of said undercap and said body consists essentially of said undercap in place over said tube and said open end of said skirt and said shoulder in close engagement whereby the cross-sectional configuration of said skirt and said shoulder cooperate to resist relative rotation of said body and said undercap, and wherein said undercap is removably sealed to said body by a tamper resistant means circumferentially engaging adjacent outer surfaces of said undercap and said body and said undercap prevents access to said tube and said waxy mass therein.

2. The apparatus of claim 1 wherein said protective undercap is transparent.

3. The apparatus of claim 2 wherein said protective undercap is molded from a thermo-formable material.

4. The apparatus of claim 2 wherein said protective undercap is vacuum formed from a sheet of plastic material.

5. The apparatus of claim 2 wherein said undercap is injection molded.

6. The apparatus of claim 2 wherein said tamper resistant means comprises a shrink band encircling said body and said protective undercap about the juncture therebetween.

7. The apparatus of claim 2 wherein said tamper resistant means comprises an adhesive strip wrapped about said body and said protective undercap over the juncture therebetween.

8. The apparatus of claim 2 wherein said cap is removable therefrom without disrupting said tamper resistant means.

9. The apparatus of claim 2 further comprising additional means in combination with said undercap engaging said body whereby relative rotation of said protective undercap and said body is further resisted thereby providing additional resistance to relative rotation of said tube and said body.

10. The apparatus of claim 9 wherein said additional means whereby relative rotation of said protective undercap and said body is resisted comprises cooperating detents and recesses on said undercap and said shoulder of said case body.

11. The apparatus of claim 10 wherein said additional means whereby relative rotation of said protective undercap and said body is resisted comprises said tamper resistant means.

12. The apparatus of claim 2 wherein said cooperating engaging surfaces of said undercap and said shoulder of said body have an identical polygonal cross section whereby relative rotation of said undercap and said body is resisted.

13. The apparatus of claim 1 wherein said waxy mass is a cosmetic.

14. The apparatus of claim 13 wherein said cosmetic is a lipstick.

15. The apparatus of claim 1 wherein said waxy mass is a crayon.

16. The apparatus of claim 1 wherein said waxy mass is a theatrical make-up.

17. A method for sealing and protecting a waxy mass which is propellable from a housing, the housing comprising a body, a mass tube extending from said body in a longitudinally coaxial relationship therewith, said body having an upper end surrounding said tube and forming a shoulder thereabout between said tube and the outer periphery of said body, a propelling means within said mass tube whereby said waxy mass is propellable from said mass tube in said longitudinally coaxial relationship by relative rotation of said body and said mass tube, and a cap fittable over said mass tube and having internal frictional engagement means to contact said mass tube and hold said cap in place thereover, said cap being engagable with said body in said longitudinally coaxial relationship to enclose said mass tube, the method comprising:

providing said housing containing said waxy mass with said waxy mass retracted within said mass tube, providing a protective undercap comprising an elongated transparent body comprising an endwall and a skirt depending from said endwall, said skirt having a substantially uniform wall thickness and a longitudinal dimension greater than said mass tube beyond said shoulder and less than said cap, an opening opposite said endwall having a substantially uniform cross sectional size and shape substantially identical to said shoulder, said undercap being telescopically receivable over said mass tube and within said cap and engagable with said body at said shoulder, placing said protective undercap over said mass tube such that said undercap opening engages said shoulder, releasably sealing said protective undercap to said body about the juncture therewith, and placing said cap over said protective undercap, whereby, said protective undercap encloses said mass tube and said waxy mass therewithin when said cap is in place and when said cap is removed and whereby engagement of said undercap and said body at said shoulder prevents relative rotation of said undercap and said body, thereby preventing relative rotation of said body and said mass tube.

18. The method of claim 17 wherein said protective undercap is releasably sealed to said body by an adhesive means.

19. The method of claim 17 wherein said protective undercap is releasably sealed to said body by a tamper resistant means.

20. The method of claim 17 wherein said protective undercap further comprises means engaging said body at said shoulder whereby relative rotation of said body and said undercap is prevented.

21. The method of claim 20 wherein said means engaging said body at Said Shoulder comprises detents engaging corresponding structures on said body at said shoulder.

22. The method of claim 20 wherein said means engaging said body whereby relative rotation of said body and said undercap is prevented comprises a resistant means.

23. The method of claim 20 wherein said means engaging said body whereby relative rotation of said body and said undercap is prevented comprises cooperating engaging surfaces of said undercap and said shoulder wherein said shoulder said undercap each have an identical polygonal cross section.

24. The method of claim 17 wherein said waxy mass is a cosmetic.

25. The method of claim 24 wherein said cosmetic is a lipstick.

26. The method of claim 17 wherein said waxy mass is a crayon.

27. The method of claim 17 wherein said waxy mass is a theatrical makeup.

* * * * *